US007910050B2

(12) United States Patent
Winkelmann et al.

(10) Patent No.: US 7,910,050 B2
(45) Date of Patent: Mar. 22, 2011

(54) STOPPER FOR A METALLURGICAL MELTING POT

(75) Inventors: Manfred Winkelmann, Krefeld (DE); Erika Winkelmann, legal representative, Krefeld (DE); Markus Fauhl, Langerwehe (DE); Jürgen Pernot, Mönchengladbach (DE); Helmut Müller, Krefeld (DE)

(73) Assignee: Refractory Intellectual Property GmbH & Co. KG, Vienna (AT)

( * ) Notice: Subject to any disclaimer, the term of this patent is extended or adjusted under 35 U.S.C. 154(b) by 497 days.

(21) Appl. No.: 11/916,743

(22) PCT Filed: Jun. 14, 2006

(86) PCT No.: PCT/EP2006/005395

§ 371 (c)(1), (2), (4) Date: Jun. 9, 2008

(87) PCT Pub. No.: WO2006/136285

PCT Pub. Date: Dec. 28, 2006

(65) Prior Publication Data

US 2010/0044402 A1 Feb. 25, 2010

(30) Foreign Application Priority Data

Jun. 21, 2005 (DE) ..... 10 2005 029 033

(51) Int. Cl.
*C21C 5/48* (2006.01)

(52) U.S. Cl. ..... 266/272; 222/603; 222/602

(58) Field of Classification Search ..... 222/602, 222/603; 266/271, 272

See application file for complete search history.

(56) References Cited

U.S. PATENT DOCUMENTS

| | | | | |
|---|---|---|---|---|
| 4,706,944 | A * | 11/1987 | Lee | 222/603 |
| 2008/0106011 | A1 * | 5/2008 | Lee et al. | 266/272 |

FOREIGN PATENT DOCUMENTS

| | | | |
|---|---|---|---|
| EP | 0 179 837 | B1 | 6/1988 |
| EP | 0 358 535 | B2 | 5/2000 |
| EP | 1 401 600 | B1 | 10/2004 |
| FR | 2787045 | | 6/2000 |
| WO | 01/08837 | A1 | 2/2001 |
| WO | 2005/059185 | A1 | 6/2005 |

* cited by examiner

*Primary Examiner* — Scott Kastler

(74) *Attorney, Agent, or Firm* — Christopher L. Parmelee; Walker & Jocke

(57) ABSTRACT

The invention relates to a stopper for a metallurgical melting pot with. Stoppers of this type serve to control the discharge of a molten metal in the area of an outlet of an associated melting pot, for example, a tundish.

11 Claims, 2 Drawing Sheets

STOPPER FOR A METALLURGICAL MELTING POT

The invention relates to a stopper for a metallurgical melting pot. Stoppers of this type serve to control the discharge of molten metal in the area of an outlet of an associated melting pot, for example a tundish.

Such a stopper usually has the following structure: it exhibits a rod-type body of at least one refractory ceramic material which, correspondingly, exhibits a first upper end and a second lower end. A sack-type aperture extends from the first end in the axial direction of the rod-shaped body towards the second end, this aperture ending at a bottom at a distance to the second end of the body. A gas discharge channel with a smaller cross-section area compared with the aperture connects the bottom of the aperture with a surface section in the area of the second end of the body. Adjacent to the first end, the aperture exhibits fixing aids on the side of the circumference, which fixing aids serve the purpose of establishing a corresponding retaining device, usually a retaining rod, via which the stopper is attached to a manipulator. By means of the manipulator, the stopper is moved tip and down in order to either seal the discharge aperture of the melting pot or to open it up to an adjustable aperture width.

Within the framework of this application, the data regarding the design and functioning of the stopper and its parts and devices relate always to the operating position of the stopper, i.e. its vertical alignment.

A known stopper of the species-appropriate type is known from EP 0 358 535 B2. Reference is made to this disclosure.

The aperture and the connecting gas discharge channel (also) serve the purpose of passing a gas through the stopper into the metal melt. The gas serves the purpose of secondary metallurgical treatment of the melt. By means of this, non-metallic inclusions in the melt, for example, are to be removed by flotation. Of importance in this connection is a constant stream of the treatment gas.

If the stopper is in a position at a distance to the discharge aperture of the melting pot, the metal melt flows out. As a result of the stream of the metal melt, a reduced pressure may be formed below the lower end of the stopper. This reduced pressure can become so great that the gas stream is severed. Simultaneously, air can be sucked in. Both are undesirable.

EP 1 401 600 B1 describes a species-appropriate stopper (referred to as monoblock stopper in this case) in which a calibration device is built into the gas discharge channel. This calibration device consists of a rod exhibiting one or several axial gas channels. In this way, a specific flow resistance is to be adjusted. The known device is complicated to produce. Moreover, it is difficult to adjust a specific flow resistance.

The invention is based on the object of providing a stopper which is easy to produce and by means of which the transportation and supply of gas, in particularly inert gas, into a metal melt can take place effectively and safely.

To achieve this object, the invention is based on the following considerations: the above-mentioned sack type aperture in the stopper body usually exhibits a circular cross-sectional area with a diameter of several centimeters. The gas discharge channel connected to the aperture in contrast has a much smaller cross-sectional surface, usually with a diameter of only a few millimeters.

The large aperture usually extends over more than half of the total length of the stopper body, whereas the gas discharge channel runs only in the second lower end section and is correspondingly short.

In order to adjust a certain flow resistance for the gas within the stopper, it is, however, necessary to design the gas channel on the end side to be as long as possible or with a smaller diameter. Based on the sketched arrangement, both measures are subject to limits.

Insofar the invention is based on the consideration of moving the means for adjusting the gas flow resistance from the area of the gas discharge channel at the lower second end of the stopper into the aperture situated above it. The aperture which is much larger in comparison with the gas discharge channel has to be filled for this purpose at least partly with a corresponding packing. This packing may extend over a corresponding partial length of the aperture (viewed in the axial direction of the stopper body) and fills the entire cross-sectional area of the aperture.

Moving the means for adjusting the gas flow resistance into the aperture creates numerous possibilities for adjusting the flow resistance individually depending at which point of the aperture and with which length the packing is formed and how many channels are arranged in what form within the packing.

Accordingly, the invention relates in its most general embodiment to a stopper for a metallurgical melting pot with the following characteristics:

a rod shaped body of at least one refractory ceramic material with a first upper end and a second lower end, a sack-type aperture extends from the first end in the axial direction of the body in the direction towards the second end, the aperture ends at a bottom at a distance to the second end of the body, a gas discharge channel connects the aperture with a surface section in the area of the second end of the body, the gas discharge channel has a cross-sectional area which is smaller than the cross-sectional area of the aperture, a packing extends over part of the aperture—viewed in the axial direction of the body, at least one gas channel which connects the aperture with the gas discharge channel in a flow-technological manner extends through the packing or between the packing and the body.

The above-mentioned bottom of the aperture can be designed as desired. It can run more or less vertically to the axial direction of the body. It can also be curved, e.g. curved in a concave or convex manner, it is also possible to shape the bottom area—viewed in the axial direction of the stopper—in the form of a funnel with direct connection to the subsequent gas discharge channel.

The packing (with the gas channels running therein) can—as detailed—have almost any desired length. Its length, will depend, among other things, on how great the flow resistance is to be which is desired for the gas stream in the application concerned. Normally, the packing—viewed in the axial direction of the body—will have a length which amounts to at least 5% of the length of the aperture. This value can also be increased, according to different embodiments, to >10%, >15%, up to values of >25%.

The arrangement of the packing within the aperture is also almost as desired. The packing can be impervious except for the gas passage area.

An arrangement of the packing directly adjacent to the bottom of the aperture, however, has flow-technology advantages. For this purpose, it is necessary to ensure that the bottom-side aperture of the gas channel which runs within the packing or in the contact area between the packing and the body of the stopper is connected in a flow technology manner with the aperture on the gas inlet side of the gas discharge channel at the lower end of the stopper (at the so-called stopper head).

Usually, stoppers of the type indicated are produced by isostatic pressing. During this process, the aperture and the gas discharge channel are formed in situ. As an example, the packing can subsequently be poured in in the case of such a stopper body. A possible production process for this purpose is illustrated as part of the description of the figures below.

The packing can also be a compressed part which is inserted during the production or subsequently into the aperture of the prepressed stopper body.

An essential feature is the formation of the at least one gas channel. This gas channel may run in the axial direction of the packing, i.e. in the axial direction of the stopper. The gas channel can run through the packing. It can also be formed on the outside wall of the packing in the form of a groove. The wall of the aperture restricts tine gas channel in this case on the outside. Conversely, the wall of the aperture may exhibit a groove and the packing (its circumferential surface) limits the groove in this case on the inside such that a gas channel is formed. The gas channel can be arranged parallel to the central longitudinal axis of the stopper or in the form of a spiral around the central longitudinal axis.

For the reasons indicated above, it may be advantageous to form a longer gas channel. For this purpose, the length of the packing can be enlarged. A particular advantage of the design according to the invention consists of the packing being arranged within the large aperture and consequently exhibiting a considerable cross-sectional area which allows the gas channel to meander or pass in the form of a helix through the packing or between the packing and the body. In this way, its length becomes much longer than the shortest distance between its (lower and upper) discharge apertures situated at the ends.

To prevent foreign bodies from penetrating inside, for example, it may be advantageous to cover at least the upper aperture of the gas channel of the packing and/or the end of the gas discharge channel on the gas inlet side with a porous filter, for example a porous, temperature-resistant filter paper or with a porous stopper. Such a porous sponge-like element may also be provided as a component of the packing.

In order to achieve a gas flow which is as free from turbulence as possible, a further embodiment of the invention provides for allowing the gas discharge channel to exit at the second end of the body coaxially to the central longitudinal axis of the body.

BRIEF DESCRIPTION OF THE DRAWINGS

Further characteristic features of the invention result from the characteristic features of the sub-claims and the other application documents.

The invention will be explained in further detail below by way of a practical example. In this,—in a strongly schematised illustration—

DETAILED DESCRIPTION

In the Figures, identical structural parts or those with an equivalent effect are illustrated with the same reference numbers.

Figure 1:
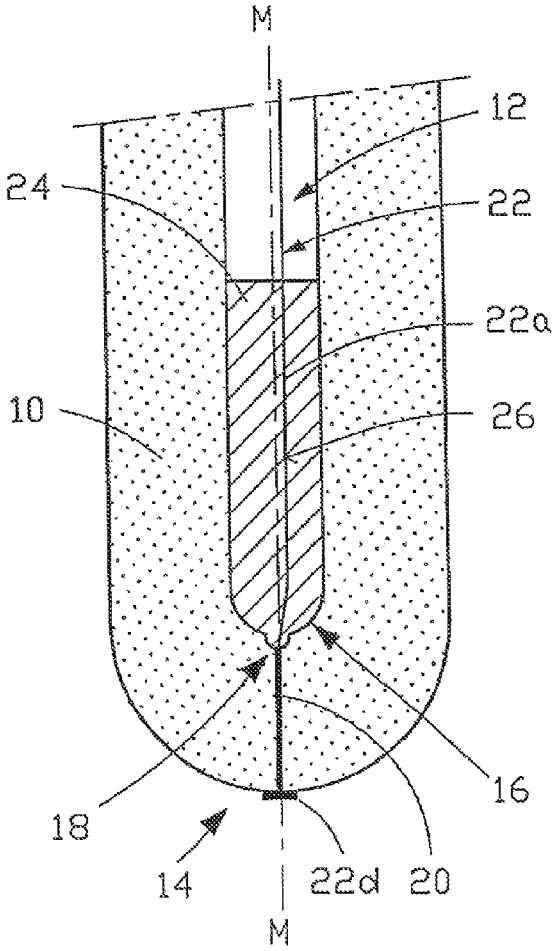
FIG. 1 shows: a lower end section of a stopper in the form of it longitudinal cross-section during manufacture.

In FIG. 1, a lower section 10 of a rod-shaped body of a stopper can be seen. The rod-shaped body consists of a refractory material of the usual type. Coaxially to the central longitudinal axis M-M, an aperture 12 extends in the body 10, which aperture extends from an upper end of the body 10 (not shown) in the direction towards a second lower end 14 and ends at a distance to this end in the area of a bottom 16. From this bottom 16 which exhibits a sack-type elongation 18 in the direction of the central longitudinal axis M-M, a gas discharge channel 20 extends coaxially to the central longitudinal axis M-M up to the bottom-most section of the second end 14.

FIG. 1 shows a stage in the manufacture of the closure body, the body 10 being produced initially in the usual manner by isostatic pressing. In a subsequent step, a wire 22 is pulled in via the gas discharge channel 20, the wire 22 exhibiting at its free lower end a thickening 22*d* whereas the section lying in the gas discharge channel 20 has a larger diameter (largely filling the gas discharge channel 20) than the section 22*a* running above it which extends through the aperture 12 up to the first upper end of the closure body and is there temporarily fixed in a manner not illustrated. In the next step, a refractory concrete is poured into the aperture 12 and pushed forwards by means of a plunger until approximately the shaded area above the gas discharge channel 20 is filled with the still viscous concrete which thus encloses the wire 22 in section 22*a*.

As soon as the concrete has set, the wire 22 is removed in the direction opposite to its introduction. For this purpose, the wire 22 can be griped at the head 22*d* and pulled out downwards. In parallel, a corresponding gas channel 26 is formed in cast concrete section 24, in the following referred to as packing, which channel continues to become the gas discharge channel 20.

It can be seen that the number of gas channels 26 formed in the packing 24, their size and course can be adjusted as desired.

Instead of one or several wires which are pulled out, bodies that can be burned out can also be used. During subsequent firing of the stopper, the desired gas channels are formed in the desired arrangement and geometry by burning out these inserts.

Figure 2:
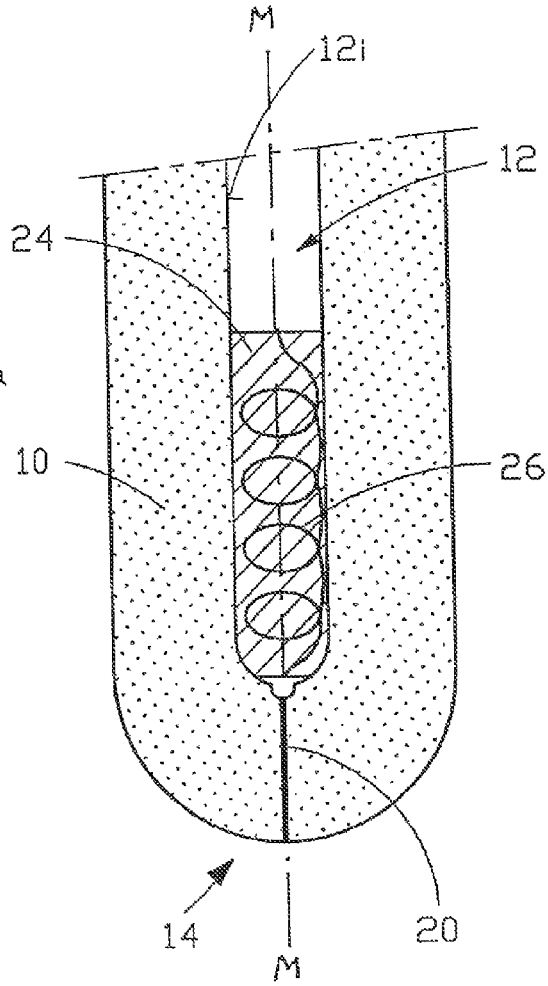
FIG. 2: shows: an illustration analogous to FIG. 1 in the finished state with a specific course of a gas channel in the packing.

Instead of a cast packing 24, this can also be used as a previously made, e.g. pressed, structural part, as sketched in FIG. 2. In the practical example illustrated, the pressed packing insert 24 exhibits a gas channel 26 formed in the form of a spiral whose lower end on the outlet side runs coaxially to the central longitudinal axis M-M of the body 10.

Figure 3:
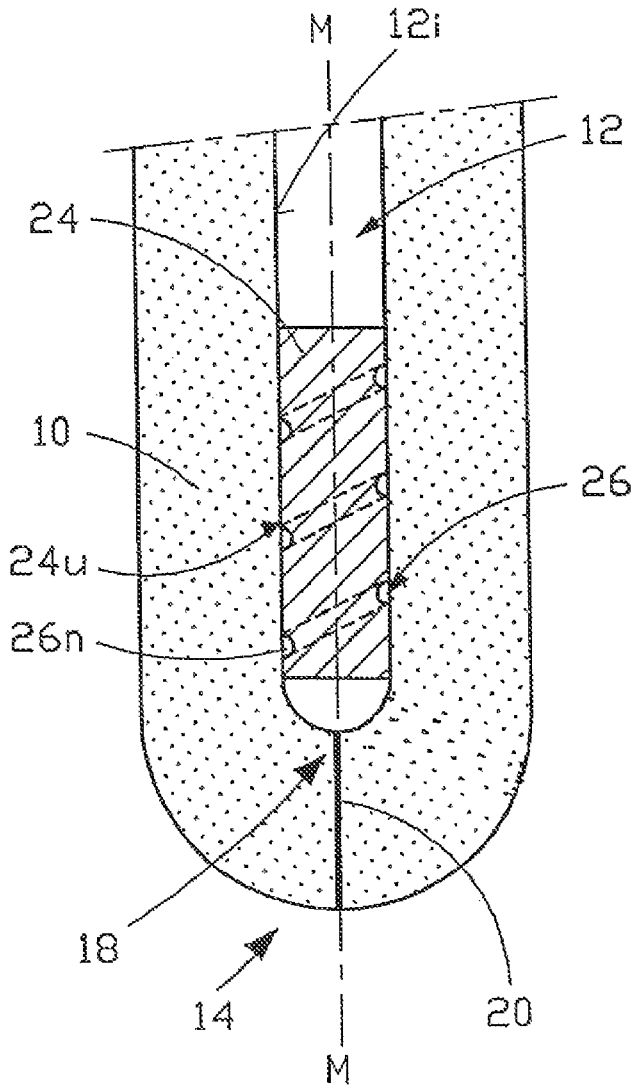
FIG. 3 shows an alternative stopper.

A further alternative is shown in FIG. 3. The gas channel 26 is formed in the transition area of the packing 24 and the body 10. The packing 24 exhibits a spiral groove 26*n* on its circumferential surface 24*u* which is bordered on the outside by the bordering wall 12*i* of the aperture 12. The gas channel 26 is formed jointly by the packing 24 and the body 10, which gas channel creates a flow-technology connection from the aperture 12 to the gas discharge channel 20.

The invention claimed is:

1. Stopper for a metallurgical melting pot with the following characteristic features:

a) a rod shaped body (10) of at least one refractory ceramic material with a first upper end and a second lower end (14), b) a blind aperture (12) extends from the first end in the axial direction of the body (10) in the direction towards the second end (14), c) the aperture (12) ends at a bottom (16) at a distance to the second end (14) of the body (10), d) a gas discharge channel (20) connects the aperture (12) with a surface section in the area of the second end (14) of the body (10), e) the gas discharge channel (20) has a cross-sectional area which is smaller than the cross-sectional area of the aperture (12), f) a packing (24) extends over part of the aperture (12)—viewed in the axial direction of the body (10), g) at least one gas channel (26) extends through the packing (24) or between the packing (24) and the body (10), which gas channel (26) connects the aperture (12) with the gas discharge channel (20) to allow a gas flowing therethrough, h) at least one gas channel (26) has a length which is greater than the shortest distance between its discharge apertures situated at its ends to adjust flow resistance of the gas flowing within the stopper.

2. Stopper according to claim 1 in which the packing (24)—in the axial direction of the body (10)—has a length which is at least 0.05 times the length of the aperture (12).

3. Stopper according to claim 1 in which the packing (24) runs adjacent to the bottom (16) of the aperture (12).

4. Stopper according to claim 1 in which the packing (24) is a cast part.

5. Stopper according to claim 1 in which the packing (24) is a pressed part.

6. Stopper according to claim 1 in which the at least one gas channel (26) extends in the axial direction of the body (10).

7. Stopper according to claim 1 in which the at least one gas channel (26) is formed in a meandering manner or formed as a helix.

8. Stopper according to claim 1 in which the packing (24) is designed at least sectionally as a porous filter.

9. Stopper according to claim 1 in which the gas discharge channel (20) exits at the second end (14) of the body (10) coaxially to the central axis of the body (10).

10. Stopper according to claim 1 in which the at least one gas channel (26) is formed at least partially by a surface indentation of the packing (24).

11. Stopper according to claim 1 in which the at least one gas channel (26) is formed at least partly by a surface indentation on a boundary wall (12*i*) of the aperture (12).

* * * * *